United States Patent [19]

Weber et al.

[11] Patent Number: 4,934,232

[45] Date of Patent: Jun. 19, 1990

[54] CIRCULAR CUTTING MACHINE

[75] Inventors: Günther Weber, Oberer Birkenweg 17b, Biedenkopf-Wallau, 3560; Horst Heinze, Battenberg/Eder, both of Fed. Rep. of Germany

[73] Assignee: Günther Weber, Biedenkopf-Wallau, Fed. Rep. of Germany

[21] Appl. No.: 188,862

[22] Filed: May 2, 1988

[30] Foreign Application Priority Data

May 4, 1987 [DE] Fed. Rep. of Germany ..... 3714810

[51] Int. Cl.[5] ..... B26D 5/20

[52] U.S. Cl. ..... 83/355; 83/409; 83/437

[58] Field of Search ..... 83/355, 356, 595, 596, 83/304, 305, 323, 409, 437, 86, 467 A, 467 R

[56] References Cited

U.S. PATENT DOCUMENTS

| | | | |
|---|---|---|---|
| 2,642,910 | 6/1953 | Garapolo | 83/355 |
| 4,015,494 | 4/1977 | Spooner et al. | 83/409 X |
| 4,226,147 | 10/1980 | Kumzi | 83/37 |
| 4,512,228 | 4/1985 | Tarcisio | 83/355 |
| 4,523,501 | 6/1985 | Mengel | 83/355 X |
| 4,548,108 | 10/1985 | Dennis | 83/27 |
| 4,580,477 | 4/1986 | Flammann | 83/467 R X |

*Primary Examiner*—Frank T. Yost
*Assistant Examiner*—Eugenia Jones
*Attorney, Agent, or Firm*—Townsend and Townsend

[57] ABSTRACT

A circular cutting machine is described which is characterised in that a product supply carriage, into which the guide for the material to be cut, the feed device and means for holding the material to be cut are integrated, can be switched over between an operating position and a retracted position by means of an actuating unit, thus permitting the product to be guided right-up to the immediate vicinity of the cutting knife. A change-over between the operating position and the retracted position can also be obtained by corresponding displacement of the cutting plane.

5 Claims, 1 Drawing Sheet

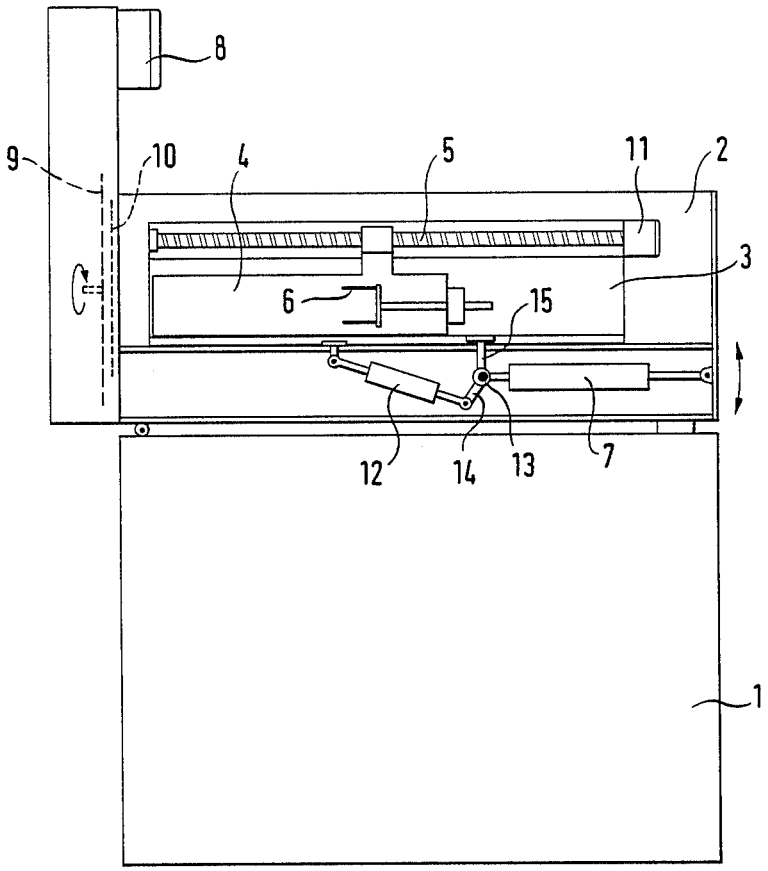
8
9
10
4
5
11
2
3
6
15
12
14
13
7
1

CIRCULAR CUTTING MACHINE

The invention relates to a circular cutting machine for cutting up food products, in particular sausage, ham, bacon, meat, cheese and the like, comprising a basic frame on which are arranged, in particular with adjustable inclination, a cutting head having a circular knife which rotates in planetary manner, and also a product supply unit with a guide for the product to be cut, with means for holding the material to be cut and with a feed means.

Such circular cutting machines are known and are used to cut large quantities of food products into slices at the highest speed possible, with the cut products being further processed, in particular packed, in overlapping or stack-like manner.

A disadvantage of the known machines is above all that troublefree cuts are only obtained when the product to be cut up has a specific consistency, which is in particular achieved by cooling, and that when operating with empty cuts a disturbingly high proportion of scrap is formed which is unfavourable from the point of view of economy.

The principal object underlying the invention is to develop a cutting machine of the kind initially set forth in such a way that with a rapid cutting sequence troublefree cuts can be obtained, even when the material to be cut has an unfavourable consistency as judged by the customary criteria, and in particular is not cooled or cooled too little, and in such a way that the occurrence of disturbing scrap formation can be prevented.

This object is satisfied in accordance with the invention essentially in that the relative position between at least the parts of the product supply unit which essentially hold the product and the cutting plane of the knife can be changed over a predeterminable stroke by means of a controllable actuating unit, in particular for a short period of time.

Through this measure it is possible to always guide the product to be cut-up directly up to the cutting plane without problem and to support it, with this result being achieved either by displacement of the cutting plane relative to the product guide, or by displacement of the product guide relative to the cutting plane. In so doing it is also possible to additionally provide a stationary product guide section directly adjacent the cutting plane, to arrange a slider between this guide section and a movable section of the guide, with the slider being capable of being pivoted out of the way, and to so control the position of the movable section of the guide via the actuating unit that the zone of the slider is crossed by this movable section of the guide when the slider is pivoted out of the way, so that once again a continuous product guide is provided.

An advantageous embodiment of the invention is characterised in that the product supply unit comprises an outer frame which is journalled on the basic frame and a carriage which is displaceably guided on the outer frame; in that the feed means, the guide for the material to be cut and the means for holding the material to be cut are integrated into the carriage; and in that a controllable actuating unit, in particular in the form of a piston-in-cylinder arrangement for generating a predeterminable relative stroke between the outer frame and the carriage, is provided between the outer frame and the carriage.

By separating the product supply unit into an outer frame, which is mounted on the basic frame, and a carriage, which carries all the operating units and is displaceably guided on the outer frame and can be displaced relative to the outer frame in the defined manner by means of an actuating unit, it is possible to bring the knife side end of the carriage, and thus the guide for the product to be cut-up, into the direct vicinity of the circular knife which is rotating in planetary manner and about its own axis.

In this way it is possible to ensure that the product to be cut up is guided in problemfree manner close up to the cutting plane, and to thus ensure troublefree cuts which are largely independent of the product consistency.

No problems exist in practice in moving the guide for the material to be cut by means of the actuating unit immediately after switching on the machine up to a minimum distance of, for example, 1 mm from the knife. This is however the same as saying that it is possible through the measure of the invention, for the guide for the material to be cut up to cross the intermediate space which is required in such circular cutting machines for a slider which is arranged in front of the circular knife and which is removable to allow access to the knife during cutting of the food product involved. Thus the guide for the material to be cut up can always be led directly up to the circular knife when this slider is moved or pivoted out of the way.

At least the knife-side end of the guide for the material to be cut can consist of plastic so that damage or destruction of this knife is avoided, in the event the circular knife does not run true, if the knife should hit the guide or should slide past it.

In accordance with a particularly advantageous embodiment of the circular cutting machine of the invention a positioning member is provided between the carriage and the carriage side hinge for the actuating unit in order to displace the hinge point of the actuating unit. This positioning member preferably consists of a piston-in-cylinder arrangement, the stroke of which, which acts on the carriage, amounts to only a fraction of the stroke of the actuating unit and which can be controlled independently of this actuating unit. The piston-in-cylinder arrangement forming the positioning member expediently acts via a lever on an eccentric axle on which the actuating unit and a connecting part fixed relative to the carriage are hinged, with the carriage being moved relative to the actuating unit or to the outer frame via the lever adjustment.

In this manner it is ensured that on actuating the positioning member the carriage is retracted by a small amount, for example by about 1 mm, i.e. removed from the circular knife so that the knife can execute an empty cut or several empty cuts until this retraction movement is cancelled. The feed for the product to be cut-up is stopped at the same time as the retraction movement is brought about via the positioning member.

As a result of the minimal return movement of the carriage with simultaneous stopping of the feed it is ensured that the extremely disturbing scrap formation which occurs with the known cutting machines is avoided. Whereas, in known circular cutting machines, it is only the advance which is stopped in order to execute empty cuts, while the material being cut, which stands under a certain prestress, relaxes and enters into the cutting plane so that scrap formation results, the small return stroke of the carriage of the apparatus of the invention ensures that the material to be cut-up does not enter into the cutting plane, despite the relaxation effect which also occurs here, and thus that no scrap formation occurs.

The avoidance of scrap formation when carrying out empty cuts is not only of significance with regard to the economy of the cutting up process but rather also because the intentional use of empty cuts makes a considerably higher overall cutting speed possible. When increasing the cutting speed without using empty cuts it is namely necessary to allow the band which is provided to carry away the cut-up products to run increasingly faster. Even at a relatively early stage of this increase in speed the individual slices on the conveyor band tend to slide relative to one another or indeed fly off the band. Particularly critical situations then rapidly occur when cuts are made portionwise, since in this case jolt-like intermediate accelerations of the band are required between the individual portions. If, however, empty cuts are provided then one obtains on the whole a substantially smoother band movement even at substantially increased cutting speed. A precondition for being able to operate in practice with the empty cuts required for ideal band movement is however in turn the ability to avoid disturbing scrap formation. For this reason the measures of the present invention which avoid this scrap formation are of particular significance.

If empty cuts are carried out then in many cases the first slice cut after the empty slices has a somewhat larger thickness as a result of the already mentioned relaxation effect. A corresponding weight compensation can be made via the control programm of the machine for which purpose provision can for example be made that only 90% of the desired advance is used for the first cut after empty cuts and that an advance of 110% is used for the next cut. The sequentially cut slices can thus be made uniform without difficulties via the corresponding control programm.

In corresponding manner a specific initial piece thickness can also be preset via the machine control and in this case a good cut surface is provided for the further cutting processes and a defined partly cut piece results which can be sold separately.

It is furthermore of advantage, for products having a cross-section which changes along the length of the product, as is for example the case with ham, that the respective abutment can be moved laterally in order to ensure the best possible overall guidance of the product during the entire cutting procedure. For this purpose an abutment is used which is automatically pressed on by a spring. This abutment can cooperate with a toothed latching strip which can be released at the end of the cutting process so that the abutment can once again be fed back into its initial position.

Further advantageous embodiments of the invention are set forth in the subordinate claims.

An embodiment of the is illustrated in the drawing, the single figure of which shows a highly schematic sideview of a circular cutting machine to explain the operating principle of the invention.

On the box-like basic frame 1, in which the entire electronic control can in particular be accommodated, there is provided an outer frame 2, the inclination of which can be varied in accordance with the double arrow shown in the drawing. A carriage 3 is displaceably mounted in the outer frame 2.

The carriage 3 has a guide 4 for the material to be cut which is displaceable by means of a feed device 5 which is driven by a motor 11, and indeed perpendicular to a cutting plane in which a circular knife 9 moves.

The circular knife 9 is driven in planetary manner and about its own axis.

The feed device 5 is preferably formed as a cooperating ball nut and spindle arrangement with the spindle being driven by the motor 11. The circular knife 9 is located in a cutting head with which at least one drive 8 is associated.

Holding means 6 are also mounted in the carriage 3 and can for example consist of pneumatically actuated grippers in order to engage and also to fix the material to be cut.

A slider 10 is located between the carriage 3 and the circular knife 9 and has a protection and abutment function. After a new piece of food has been inserted and the machine switched on, the slider 10 is swung away or moved away whereupon access to the circular knife 9 is possible.

The carriage 3 which carries all the elements required for the supply and holding of the product is adjustable by means of an actuating unit 7 between an advanced position and a retracted position.

The actuating unit 7 which preferably consists of a pneumatic piston-in-cylinder arrangement is arranged between the outer frame 2 and the carriage 3. The piston-in-cylinder arrangement engages with a connecting part 15 which is fixedly mounted on the carriage and indeed, in accordance with a preferred variant, via a fork-like connecting member through which an axle passes which forms a pivot point 13.

When the carriage is advanced after switching on the machine by the actuating unit 7 into its operating position then the intermediate space required for the slider 10 is crossed and the guide for the material to be cut is brought into the immediate neighbourhood of the knife 9. In this manner it is ensured that the material to be cut, which is preferably still loaded from above by means of a hold-down clamp, is guided into the most immediate vicinity of the knife. This has the consequence that even products which have a consistency which is little suited to the execution of cuts can be cut into slices in trouble-free manner.

A positioning member 12 which preferably likewise consists of a pneumatic piston-in-cylinder arrangement is inserted between the carriage 3 and the hinge point 13 for the actuating unit 7. The positioning member 12 engages via a lever 14 with the axle which couples the actuating unit 7 to the connecting part 15 which is rigidly connected to the carriage. This axle is constructed as an eccentric axle so that pivoting of the lever 14 leads to a displacement of the hinge point 13 and thus to a small displacement of the carriage 3.

It is accordingly possible on actuating the positioning member 12 to move the carriage 3, and thus all the elements integrated into this carriage, over a small stroke, for example over a stroke of approximately 1 mm away from the circular knife 9 and towards the circular knife 9. This minimum stroke which can be executed within a very short period of time makes it possible to execute empty cuts without problem, i.e. cuts which do not lead to the formation of any scraps. If an empty cut is required by the programm then a return stroke of the carriage 3 is executed by means of the positioning member 12 simultaneously with the stopping of the feed device 5, so that even if the material to be cut relaxes it cannot enter into the cutting plane.

This carriage movement, which can be effected in a very short period of time using little force as a result of the mechanical advantage of the eccentric transmission, for the purpose of making scrap-free empty cuts possible, also has the consequence that the number of the empty cuts which is desired in a particular case can be freely predetermined. This is possible since the relaxation effect which sets in for the particular product to be cut is not so large that, for example, there is a danger that although the first two empty cuts do not produce any scraps the food product to be cut up will nevertheless enter into the cutting plane as a result of relaxation during subsequent empty cuts. It is possible, through the free choice of the number of empty cuts which are to be provided in any particular case, to make the movement of the band which is used to transport the cut slices move uniform, in the manner which is desired and required in particular cases, so that the operation can take place at a high cutting speed without problems due to individual slices sliding about on the transport band.

We claim:

1. A circular cutting machine for cutting up food products comprising a basic frame on which are arranged, with adjustable inclination, a cutting head having a circular knife which rotates in planetary manner, and a product supply unit including a carriage, a guide for the product to be cut, means for holding the product to be cut, feed means for advancing the unit towards the circular knife, an actuating unit for momentarily changing the relative position between the means for holding the product and the cutting plane of the knife over a predetermineable stroke, and a positioning member disposed between the carriage and a carriage hinge for the actuating unit for displacing the carriage hinge of the actuating unit, the positioning member comprising a piston-in-cylinder arrangement having a stroke amounting to a fraction of the stroke of the actuating unit, the piston-in-cylinder arrangement being controllable independently of the actuating unit.

2. A circular cutting machine in accordance with claim 1, wherein the product supply unit comprises an outer frame which is journalled on the basic frame and the carriage is displaceably guided on the outer frame, and wherein the feed means, the guide for the material to be cut and the means for holding the material to be cut are integrated into the carriage.

3. A circular cutting machine in accordance with claim 1 wherein the stroke of the positioning member is selected so that it causes a corresponding movement of the carriage away from the knife of amounts approximately 1 mm and each retraction stroke effected by the positioning member when the feed means is stationary corresponding to at least one empty cut by the knife.

4. A circular cutting machine in accordance with claim 1 wherein the piston-in-cylinder arrangement forming the positioning member acts via a lever on an eccentric axle on which the actuating unit and a connecting part fixed relative to the carriage are hinged, the carriage being moved relative tot he actuating unit and the outer frame by displacement of the lever.

5. A circular cutting machine in accordance with claim 1, including a spindle drive for the feed means, and wherein the actuating unit and the spindle drive are simultaneously activated in order to form initial cuts of the material to be cut.

* * * * *